US007387488B2

(12) United States Patent
Nichols et al.

(10) Patent No.: US 7,387,488 B2
(45) Date of Patent: Jun. 17, 2008

(54) COOLED TURBINE SHROUD

(75) Inventors: Glenn Herbert Nichols, Mason, OH (US); Kurt Grover Brink, Mason, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 326 days.

(21) Appl. No.: 11/161,500

(22) Filed: Aug. 5, 2005

(65) Prior Publication Data

US 2007/0031240 A1 Feb. 8, 2007

(51) Int. Cl.
*F03B 11/00* (2006.01)

(52) U.S. Cl. ..... 415/116; 415/171.1; 415/173.1; 415/173.4

(58) Field of Classification Search ..... 415/116, 415/171.1, 173.1, 173.4
See application file for complete search history.

(56) References Cited

U.S. PATENT DOCUMENTS 4,573,865 A * 3/1986 Hsia et al. ..... 415/115
5,039,562 A * 8/1991 Liang ..... 415/115
5,088,888 A * 2/1992 Bobo ..... 415/170.1
5,641,267 A * 6/1997 Proctor et al. ..... 415/173.1
6,354,795 B1 3/2002 White et al.
6,899,518 B2 * 5/2005 Lucas et al. ..... 415/116
2003/0138658 A1 * 7/2003 Taylor et al. ..... 416/241 B
2004/0047725 A1 * 3/2004 Tomita et al. ..... 415/116

* cited by examiner

*Primary Examiner*—Igor Kershteyn
(74) *Attorney, Agent, or Firm*—Adams Intellectual Property Law P.A.; William Scott Andes, Esq.

(57) ABSTRACT

A cooled turbine shroud includes an arcuate flow path surface adapted to surround a row of rotating turbine blades, and an opposed interior surface; a forward overhang defining an axially-facing leading edge, an outwardly-extending forward wall and an outwardly-extending aft wall; opposed first and second sidewalls, wherein the forward and aft walls and the sidewalls define an open shroud plenum; at least one leading edge cooling hole extending from the shroud plenum to the leading edge; and at least one sidewall cooling hole extending from the plenum to one of the sidewalls. The flow path surface is free of cooling holes and may include a protective coating applied thereto.

13 Claims, 5 Drawing Sheets

COOLED TURBINE SHROUD

BACKGROUND OF THE INVENTION

This invention relates generally to gas turbine engines and more particularly to shroud assemblies utilized in the high pressure turbine section of such engines.

It is desirable to operate a gas turbine engine at high temperatures most efficient for generating and extracting energy from these gases. Certain components of a gas turbine engine, for example stationary shroud segments which closely surround the turbine rotor and define the outer boundary for the hot combustion gases flowing through the turbine, are exposed to the heated stream of combustion gases. The base materials of the shroud segment can not withstand primary gas flow temperatures and must be protected therefrom Impingement cooling on the back side and film cooling on the hot flow path surface are the typical prior art practices for protecting high pressure turbine shrouds. The film cooling effectiveness on the shroud gas path surface is typically not high because the film is easily destroyed by the passing turbine blade tip. Another method to keep the shroud temperature low is to apply a layer of thermal barrier coating ("TBC") on the hot flow path surface to form a thermal insulation layer. One particular effective kind of TBC is dense vertically microcracked TBC or "DVM-TBC". To prevent spalling of the TBC, the temperature of the underlying bond coat must be kept below about 950° C. (1750° F.). Furthermore, drilling cooling holes through a TBC can damage the structure of the TBC and result in spallation. Certain prior art shrouds with a DVM-TBC have a sufficient operational life without film cooling. However, engines are now being designed to be operated at high temperatures for extended periods of time, requiring both a TBC coating and effective cooling.

Accordingly, there is a need for a turbine shroud which can provide film cooling coverage over the flow path surface without causing spallation of a coating applied thereto.

BRIEF SUMMARY OF THE INVENTION

The above-mentioned need is met by the present invention, which according to one aspect provides a shroud segment for a gas turbine engine, including: an arcuate flow path surface adapted to surround a row of rotating turbine blades, and an opposed interior surface; a forward overhang defining an axially-facing leading edge, an outwardly-extending forward wall and an outwardly-extending aft wall; opposed first and second sidewalls, wherein the forward and aft walls and the sidewalls define an open shroud plenum; at least one leading edge cooling hole extending from the shroud plenum to the leading edge; and at least one sidewall cooling hole extending from the plenum to one of the sidewalls. The flow path surface is free of cooling holes.

According to another aspect of the invention, a shroud assembly for a gas turbine engine includes: a plurality of side-by side shroud segments, each having: an arcuate flow path surface free of cooling holes and adapted to surround a row of rotating turbine blades, and an opposed interior surface; a forward overhang defining an axially-facing leading edge, an outwardly-extending forward wall and an outwardly-extending aft wall; opposed left and right sidewalls, wherein the forward and aft walls and the sidewalls define an open shroud plenum; at least one leading edge cooling hole extending from the shroud plenum to the leading edge; and at least one sidewall cooling hole extending from the plenum to one of the sidewalls. The flow path surface is free of cooling holes.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
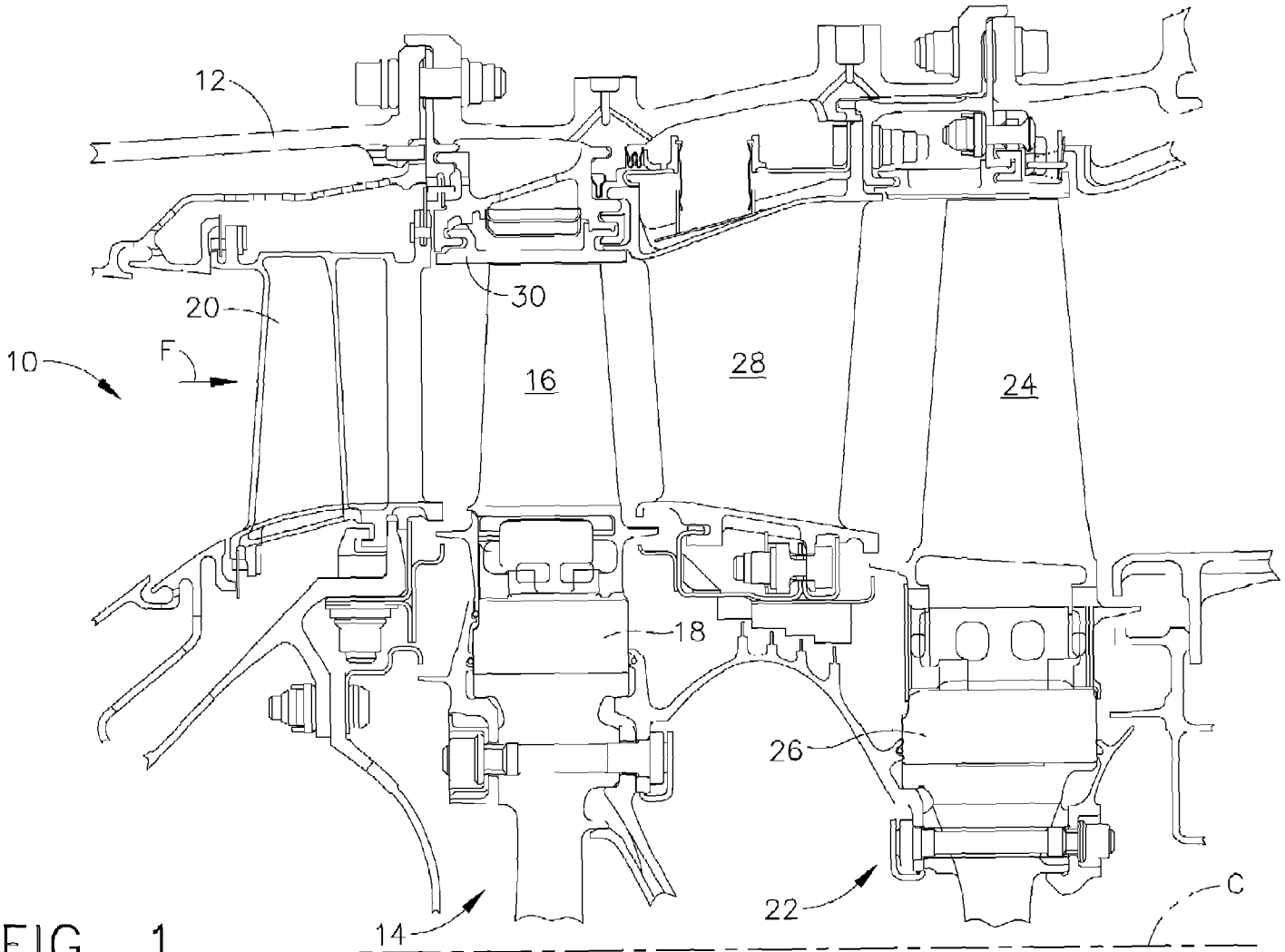
FIG. 1 is a cross-sectional view of an exemplary high-pressure turbine section incorporating the shroud of the present invention.
Figure 2:
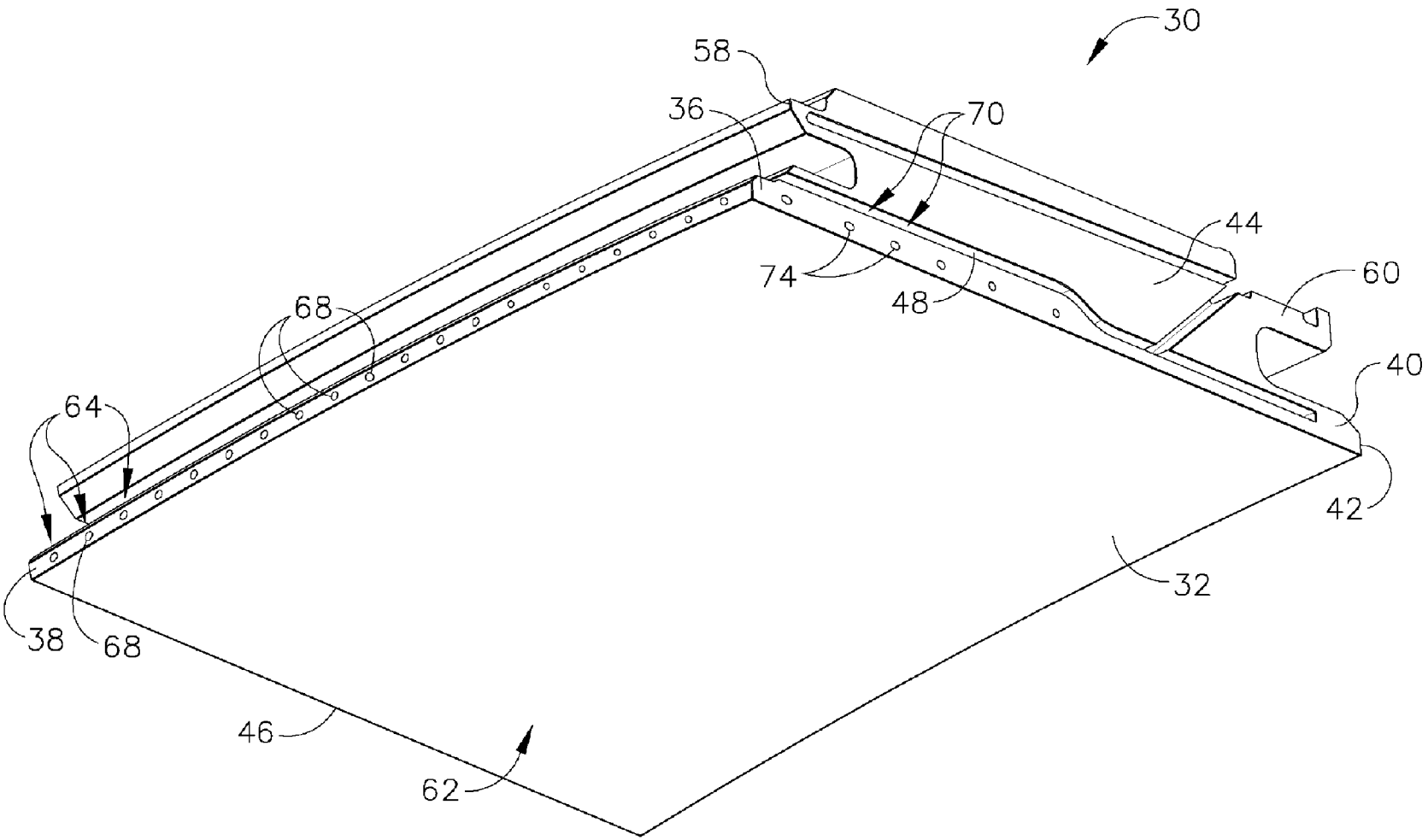
FIG. 2 is a bottom perspective view of a shroud constructed in accordance with the present invention.

Referring to the drawings wherein identical reference numerals denote the same elements throughout the various views, FIG. 1 illustrates a portion of a high-pressure turbine (HPT) 10 of a gas turbine engine. The HPT 10 includes a number of turbine stages disposed within an engine casing 12. As shown in FIG. 1, the HPT 10 has two stages, although different numbers of stages are possible. The first turbine stage includes a first stage rotor 14 with a plurality of circumferentially spaced-apart first stage blades 16 extending radially outwardly from a first stage disk 18 that rotates about the centerline axis "C" of the engine, and a stationary first stage turbine nozzle 20 for channeling combustion gases into the first stage rotor 14. The second turbine stage includes a second stage rotor 22 with a plurality of circumferentially spaced-apart second stage blades 24 extending radially outwardly from a second stage disk 26 that rotates about the centerline axis of the engine, and a stationary second stage nozzle 28 for channeling combustion gases into the second stage rotor 22. A plurality of arcuate first stage shroud segments 30 are arranged circumferentially in an annular array so as to closely surround the first stage blades 16 and thereby define the outer radial flow path boundary for the hot combustion gases flowing through the first stage rotor 14.

FIGS. 2-5 show one of the shroud segments 30 in more detail. The shroud segment 30 is generally arcuate in shape and has a flow path surface 32, an opposed interior surface 34, a forward overhang 36 defining an axially-facing leading edge 38, an aft overhang 40 defining an axially-facing trailing edge 42, and opposed left and right sidewalls 44 and 46. The sidewalls 44 and 46 may have seal slots 48 formed therein for receiving end seals of a known type (not shown) to prevent leakage between adjacent shroud segments 30. The shroud segment 30 includes an outwardly-extending forward wall 52 and an outwardly-extending aft wall 54. The forward wall 52, aft wall 54, sidewalls 44 and 46, and interior surface 34 cooperate to form an open shroud plenum 56. A forward support rail 58 extends from the forward wall 52, and an aft support rail 60 extends from the aft wall 54.

The shroud segment 30 may be formed as a one-piece casting of a suitable superalloy, such as a nickel-based superalloy, which has acceptable strength at the elevated temperatures of operation in a gas turbine engine. At least the flow path surface 32 of the shroud segment 30 is provided with a protective coating such as an environmentally resistant coating, or a thermal barrier coating ("TBC"), or both. In the illustrated example, the flow path surface 32 has a dense vertically microcracked thermal barrier coating (DVM-TBC) applied thereto. The DVC-TBC coating is a ceramic material (e.g. yttrium-stabilized zirconia or "YSZ") with a columnar structure and has a thickness of about 0.51 mm (0.020 in.)] An additional metallic layer called a bond coat (not visible) is placed between the flow path surface 32 and the TBC 62. The bond coat may be made of a nickel-containing overlay alloy, such as a MCrAlY, or other compositions more resistant to environmental damage than the shroud segment 30, or alternatively, the bond coat may be a diffusion nickel aluminide or platinum aluminide, whose surface oxidizes to a protective aluminum oxide scale that provides improved adherence to the ceramic top coatings. The bond coat and the overlying TBC are frequently referred to collectively as a TBC system.

While the TBC system provides good thermal protection to the shroud segment 30, it has certain limitations. For the best adhesion of the TBC system, it is desirable to limit the temperature of the bond coat to about 954° C. (1700° F.). The TBC 62 is also susceptible to spalling if any holes are drilled therein. Accordingly, the flow path surface 32 is free from any cooling holes which penetrate the TBC 62.

Figure 3:
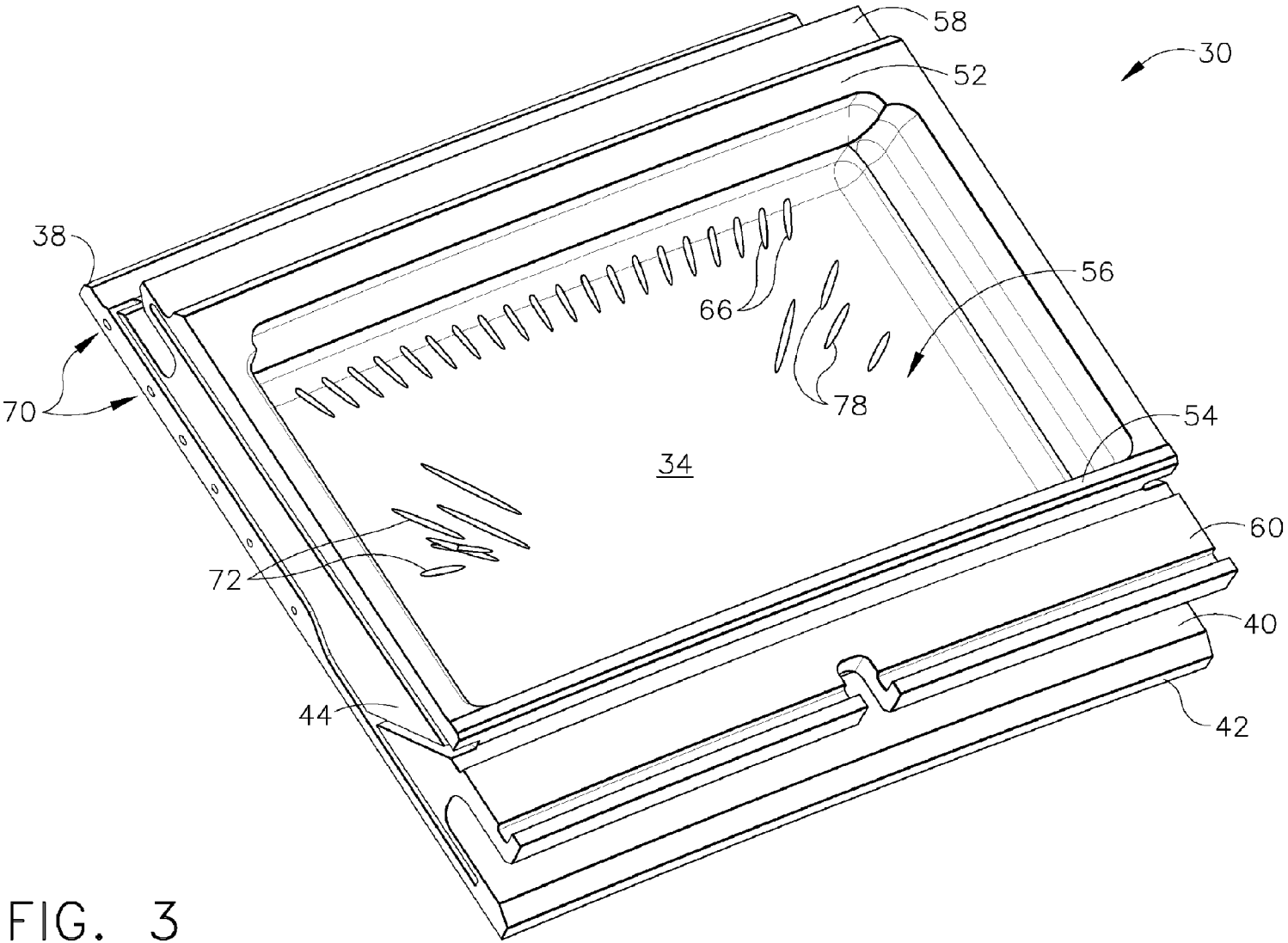
FIG. 3 is a top perspective view of the shroud of FIG. 2.
Figure 4:
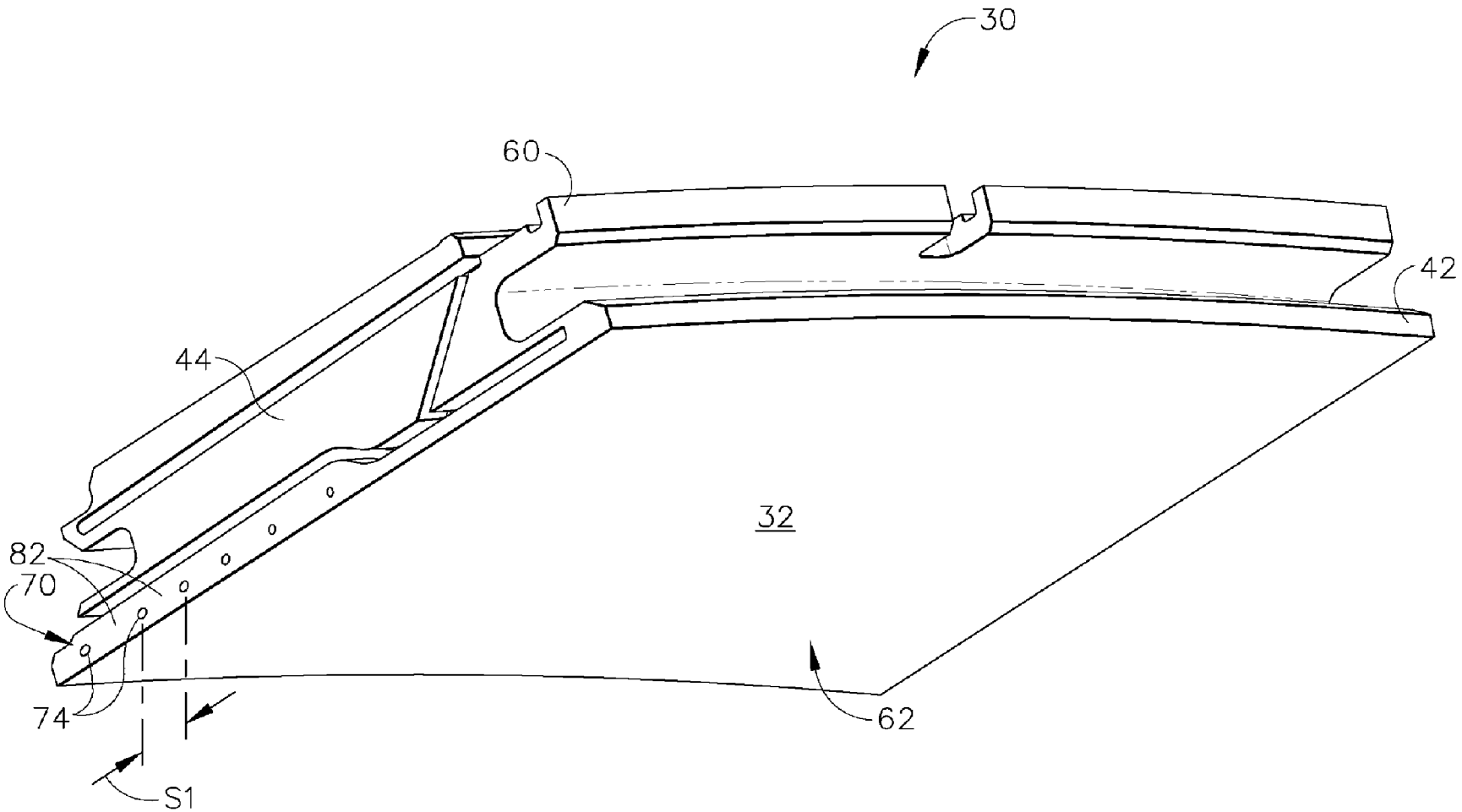
FIG. 4 is another perspective view of the shroud of FIG. 2.
Figure 5:
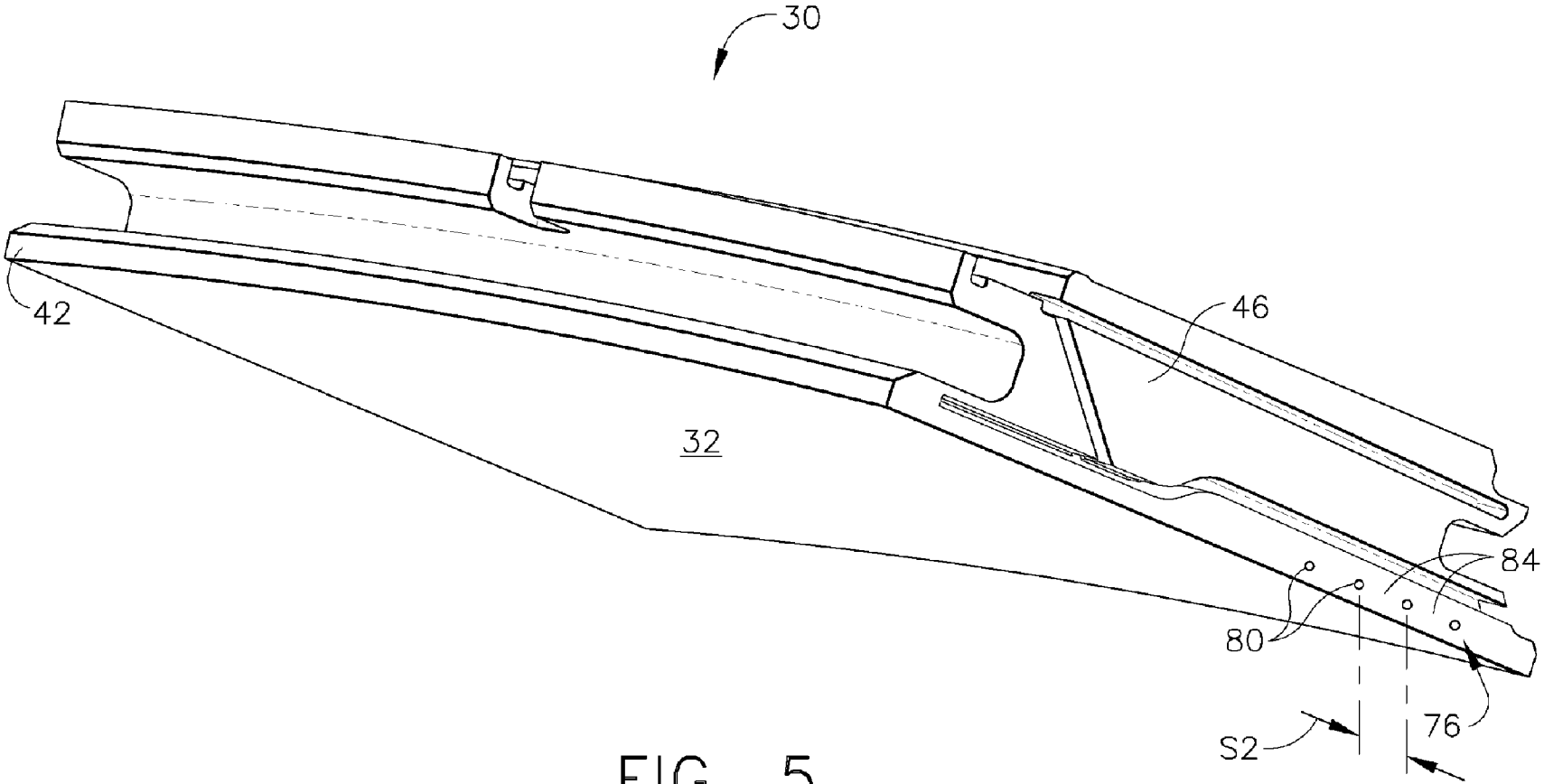
FIG. 5 is yet another perspective view of the shroud of FIG. 2.

A row of relatively densely packed leading edge cooling holes 64 is arrayed along the forward overhang 36. The leading edge cooling holes 64 extend generally fore-and-aft in a tangential plane, and are angled inward in a radial plane. Each of the leading edges cooling holes has an inlet 66 disposed in the interior surface 34, as shown in FIG. 3, and an outlet 68 in communication with the leading edge 38.

A row of left sidewall cooling holes 70 is arrayed along the left sidewall 44. The left sidewall cooling holes 70 are angled outward in a tangential plane, and inward in a radial plane. Each of the left sidewall cooling holes 70 has an inlet 72 disposed in the interior surface 34, and an outlet 74 in communication with a lower portion of the left sidewall 44. In the illustrated example there are six left sidewall holes 70 separated from each other by a distance "S1." The exact number, position, and spacing of the left sidewall cooling holes 70 may be varied to suit a particular application.

A row of right sidewall cooling holes 76 is arrayed along the right sidewall 46. The right sidewall cooling holes 76 are angled outward in a tangential plane, and inward in a radial plane. Each of the right sidewall cooling holes 76 has an inlet 78 disposed in the interior surface 34, and an outlet 80 in communication with a lower portion of the left sidewall 44. In the illustrated example there are four right sidewall holes 76 separated from each other by a distance "S2." The exact number, position, and spacing of the right sidewall cooling holes 76 may be varied to suit a particular application.

The left sidewall cooling holes 70 and the right sidewall cooing holes 76 are staggered such that flow from the right sidewall cooling holes 76 will impinge on the left sidewall 44 of an adjacent shroud segment in the areas 82 between the left sidewall cooling holes 70. Flow from the left sidewall cooling holes 70 will also impinge on the right sidewall 46 of an adjacent shroud segment 30 in the areas 84 between the right sidewall cooling holes 76.

In operation, cooling air provided to the shroud plenum 56 first impinges on the interior surface 34 of the shroud segment 30 and then exits through the leading edge cooling holes 64 and left and right sidewall cooling holes 70 and 76. The air exiting through the leading edge cooling holes 64 first purges the space between the outer band of the first stage nozzle 20 and the shroud segment 30 and then forms a layer of film cooling for the shroud flow path surface 32. The air exiting through the sidewall cooling holes 70 and 76 provides impingement cooling on the adjacent shroud sidewalls as described above.

The TBC 62 provides good thermal insulation on the flow path surface 32. The leading edge cooling holes 64 provide purge cooling and film cooling for the shroud segment 30 while leaving the structure of the TBC 62 undisturbed. In addition, the lower edges of the sidewalls are most susceptible to TBC chipping and spallation due to a "break-edge" effect as a result of the inherent shroud geometry. The strategic alignment of the left and right sidewall cooling holes 70 and 76 at these edge locations reduces and controls bond coat temperatures, thereby minimizing spallation risk. This combination of a continuous uninterrupted TBC and cooling provides a sufficiently durable TBC design for high temperature and high time operations, which is especially useful in marine and industrial turbines. The incorporation of cooling holes at the leading edge 38 and sidewalls 44 and 46 will also ensure sufficient convection and conduction cooling near these areas in the event of TBC chipping at the edges.

The foregoing has described a shroud for a gas turbine engine. While specific embodiments of the present invention have been described, it will be apparent to those skilled in the art that various modifications thereto can be made without departing from the spirit and scope of the invention. For example, while the present invention is described above in detail with respect to a first stage shroud assembly, a similar structure could be incorporated into other parts of the turbine. Accordingly, the foregoing description of the preferred embodiment of the invention and the best mode for practicing the invention are provided for the purpose of illustration only and not for the purpose of limitation, the invention being defined by the claims.

What is claimed is:

1. A shroud segment for a gas turbine engine, comprising:

an arcuate flow path surface adapted to surround a row of rotating turbine blades, and an opposed interior surface;

a forward overhang defining an axially-facing leading edge;

an outwardly-extending forward wall and an outwardly-extending aft wall;

opposed first and second sidewalls, wherein said forward and aft walls and said sidewalls define an open shroud plenum;

at least one leading edge cooling hole extending from said shroud plenum to said leading edge; and at least one sidewall cooling hole extending from said plenum to one of said sidewalls;

wherein said flow path surface is free of cooling holes and a dense vertically microcracked thermal barrier coating is disposed on the flow path surface and not on the following: the outwardly-extending forward wall, the outwardly-extending aft wall, and the opposed first and second sidewalls.

2. The shroud segment of claim 1 wherein said protective coating has a thickness of about 0.5 mm.

3. The shroud segment of claim 1 wherein:

at least one first sidewall cooling hole extends from said plenum to the first sidewall; and at least one second sidewall cooling hole extends from said plenum to the second sidewall.

4. The shroud segment of claim 3 further comprising:

a row of spaced-apart first sidewall cooling holes each having an inlet in fluid communication with said shroud plenum and a first exit in fluid communication with one of said sidewalls, said first exits being spaced apart from each other by a first spacing; and a row of spaced-apart second sidewall cooling holes each having an inlet in fluid communication with said shroud plenum and a second exit in fluid communication with the other one of said sidewalls, said second exits being spaced apart from each other by a second spacing;

said first and second sidewall cooling holes positioned so as to direct cooling air exiting therefrom to strike a sidewall of an adjacent shroud segment.

5. The shroud segment of claim 4 wherein said first and second exits are arranged such that cooling air exiting each of said first exits will strike a portion of said second sidewall between neighboring ones of said second exits; and cooling air exiting each of said second exits will strike a portion of said first sidewall between neighboring ones of said first exits.

6. The shroud segment of claim 1 further comprising a laterally-extending row of leading edge cooling holes, each of said leading edge cooling holes extending from said shroud plenum to said leading edge.

7. A shroud assembly for a gas turbine engine, comprising:

a plurality of side-by side shroud segments, each comprising:

an arcuate flow path surface free of cooling holes and adapted to surround a row of rotating turbine blades, and an opposed interior surface;

a forward overhang defining an axially-facing leading edge, an outwardly-extending forward wall and an outwardly-extending aft wall;

opposed left and right sidewalls, wherein said forward and aft walls and said sidewalls define an open shroud plenum;

at least one leading edge cooling hole extending from said shroud plenum to said leading edge;

at least one sidewall cooling hole extending from said plenum to one of said sidewalls; and wherein said flow path surface is free of cooling holes and a dense vertically microcracked thermal barrier coating is disposed on the flow path surface and not on the following: the outwardly-extending forward wall, the outwardly-extending aft wall, and the opposed first and second sidewalls.

8. The shroud assembly of claim 7 wherein said protective coating has a thickness of about 0.5 mm.

9. The shroud assembly of claim 7 wherein:

at least one first sidewall cooling hole extends from said plenum to one of said sidewalls; and at least one second sidewall cooling hole extends from said plenum to the other one of said sidewalls.

10. The shroud assembly of claim 9 further comprising:

a row of spaced-apart first sidewall cooling holes each having an inlet in fluid communication with said shroud plenum and a first exit in fluid communication with one of said sidewalls, said first exits being spaced apart from each other by a first spacing; and a row of spaced-apart second sidewall cooling holes each having an inlet in fluid communication with said shroud plenum and a second exit in fluid communication with the other one of said sidewalls, said second exits being spaced apart from each other by a second spacing; and said first and second sidewall cooling holes positioned so as to direct cooling air exiting therefrom to strike a sidewall of an adjacent shroud segment.

11. The shroud assembly of claim 10 wherein said first and second exits are arranged such that cooling air exiting each of said first exits will strike a portion of said second sidewall between neighboring ones of said second exits and cooling air exiting each of said second exits will strike a portion of said first sidewall between neighboring ones of said first exits.

12. The shroud assembly of claim 7 further comprising a laterally extending row of leading edge cooling holes, each of said leading edge cooling holes extending from said shroud plenum to said leading edge.

13. A shroud segment for a gas turbine engine, comprising:

an arcuate flow path surface adapted to surround a row of rotating turbine blades, and an opposed interior surface;

a forward overhang defining an axially-facing leading edge;

an outwardly-extending forward wall and an outwardly-extending aft wall;

opposed first and second sidewalls, wherein said forward and aft walls and said sidewalls define an open shroud plenum;

a plurality of leading edge cooling holes extending from said shroud plenum to said leading edge; and a plurality of sidewall cooling holes extending from randomly grouped openings formed on the plenum to one of said sidewalls;

wherein said flow path surface is free of cooling holes and said cooling holes are angled relative to each other such that cooling holes extend near the corners for providing cooling thereto.

* * * * *